US006643957B2

(12) United States Patent
Piron et al.

(10) Patent No.: US 6,643,957 B2
(45) Date of Patent: Nov. 11, 2003

(54) UNIT FOR THE COLLECTION, CLEANING AND CALIBRATION OF ELECTROLYSIS POTS USED FOR ALUMINIUM PRODUCTION

(75) Inventors: Gérard Piron, Lyons (FR); Serge Huon, Loffre (FR)

(73) Assignees: Reel SA, Sainte Consorce (FR); ASMI, Dechy (FR)

( * ) Notice: Subject to any disclaimer, the term of this patent is extended or adjusted under 35 U.S.C. 154(b) by 24 days.

(21) Appl. No.: 10/037,261

(22) Filed: Oct. 23, 2001

(65) Prior Publication Data

US 2003/0106246 A1 Jun. 12, 2003

(51) Int. Cl.[7] ..... B66C 3/02
(52) U.S. Cl. ..... 37/187; 294/68.23
(58) Field of Search ..... 37/184, 461, 185, 37/186, 187, 188, 444, 445, 901; 294/68.23, 88, 68.1, 68.21, 111, 112; 414/723, 725, 624–626

(56) References Cited

U.S. PATENT DOCUMENTS 3,814,471 A * 6/1974 Coeurderoy ..... 294/68.23
4,174,131 A * 11/1979 Gregg ..... 294/68.23
4,327,943 A * 5/1982 Longo ..... 294/68.23
4,908,966 A * 3/1990 Phillips et al. ..... 37/340
6,145,517 A * 11/2000 Mancuso ..... 134/22.1

FOREIGN PATENT DOCUMENTS

| | | | |
|---|---|---|---|
| DE | 3131 624 | A1 | 6/1982 |
| EP | 0 440 488 | A2 | 8/1991 |
| EP | 0 618 313 | A2 | 10/1994 |
| EP | 0 677 477 | A1 | 10/1995 |

* cited by examiner

*Primary Examiner*—Robert E. Pezzuto
(74) *Attorney, Agent, or Firm*—Heslin Rothenberg Farley & Mesiti P.C.; Victor A. Cardona, Esq.

(57) ABSTRACT

A unit for the collection, cleaning and calibration of electrolysis pots and, in particular, of anodic orifices thereof, as the anodes of an installation for the production of aluminum by igneous electrolysis are replaced, includes two buckets hinge-mounted at the level of a lower end of a shovel-bearing chassis which is vertically movable. The lower edge of each of the buckets is movable in a circular direction by a connecting rod assembly. Also the shovel-bearing chassis is joined to a vertical guide mast and is mechanically linked to the buckets-supporting chassis. The buckets-supporting chassis is moveable relative to the shovel-bearing chassis and integrates the connecting rod assembly for closing and opening the buckets with the buckets being hinge-mounted at the lower end of the buckets-supporting chassis.

20 Claims, 4 Drawing Sheets

4
2
5
32
21
11
33
12
20
10
13
31
16
17

UNIT FOR THE COLLECTION, CLEANING AND CALIBRATION OF ELECTROLYSIS POTS USED FOR ALUMINIUM PRODUCTION

The invention relates to the field of the production of aluminium by igneous electrolysis and, more particularly, to the management of certain operating stages of such installations.

BACKGROUND OF THE INVENTION

More particularly, it relates to a unit for the collection of solid parts, in suspension or not in suspension in the electrolysis bath and, in particular, of blocks of anodes unhooked from the stem on which they are fixed, but also for the cleaning and calibration of the orifice left vacant by the replaced anode.

In a known manner, the production of aluminium by igneous electrolysis makes use of the electrolysis of the aluminium in a bath of molten cryolite, according to the reaction:

$$Al_2O_3 + 2e + Na_3[AlF_6] \rightarrow 2\,Al + 3O_2 + 3C + 3CO_2 + F$$

Aluminium cryolite oxide

This reaction uses a melting bath containing a mixture of cryolite and aluminium oxide and the temperature of which is generally greater than 800° C. In consideration of the energies used and in order to limit as far as possible the losses inherent in the restart phases, installations which use this technology generally operate continuously at the level of series of aluminium pots, the number and the dimensions of which are a function, on the one hand, of the available amperage of the continuous electric current feeding the pots and, on the other hand, of the desired volume of production.

Normally, it is advisable to proceed to replace the different anodes, most often constructed in carbon, at the level of each of the pots, without, for all that, stopping the electrolytic reaction.

By virtue of the process used, namely igneous electrolysis, a hard crust of fluorinated cryolite and aluminium oxide is formed at the upper surface of the bath, this crust having the benefit of preserving the heat within the bath and thus of constituting a heat-insulating shell. Consequently, the extraction of spent anodes from the bath requires, in first place, the rupture of this crust. This rupture gives rise to the formation of fragments or solid parts floating on the surface or in suspension in the electrolysis bath and which need to be collected by means of a tool traditionally referred to as a "shovel".

This shovel has also to prepare the space and the conditions necessary for the introduction of a new anode instead of and in place of the replaceable spent anode. This preparation also consists in calibrating the space needed for the installation of a new anode of this kind. In fact, the erosion of the generally rectangular section of the carbon constituting the anode actually brings about the diminution of the said section relative to a new anode, particularly owing to the progressive disappearance of the angular parts, which become rounded.

This transformation is inherent in the consumption of the carbon constituting the anodes, by virtue of the electrolytic process used. The space which is thus released between the blocks of carbon constituting the anodes is occupied by the bath, which surface-solidifies and forms the above-mentioned crust, the rupture of which is necessary to allow, on the one hand, the withdrawal of the spent anode and, on the other hand, the installation of a new anode. Thus, when the spent anode is to be removed, the crusts adhering thereto are previously shattered by means of an appropriate tool, known as a crust pick, and larger or smaller fragments of crust fall into the bath, float to the surface thereof and hence prevent the installation of a new anode.

Moreover, more or less voluminous carbon blocks can also float in the bath following the actual pull-out operation of the anode.

Finally, on the surface of the cathode, that is to say the base of the pot, slimes originating from the electrolytic bath are deposited, the removal of which is desirable since they increase electrical resistance and hence reduce the pot production yield.

The shovel therefore fulfils firstly a collection function, secondly, a cleaning function and, finally, a calibration function. In order to ensure these different functions, it is known to use hinged buckets, the actuation of which causes their lips disposed at the level of their free edge to come together and hence to produce a shovel. Now, these buckets are hinge-mounted on a chassis, such that the actuation of the connecting rod assembly traditionally used to ensure the closure of the buckets causes the two lips to converge, describing an arc of a circle as they do so, the concavity of which is directed upwards.

Since the lips are intended to ensure a gentle dredging of the base of the pot, that is to say of the cathode, and taking into account, moreover, the weight of the buckets, their actuation mechanism and, in general terms, the weight of the shovel, this circular movement is liable to damage this cathode and, hence, the pot itself.

Consequently, and in order to avoid such damage, the vertical positioning of traditional shovels is chosen such that, when the bucket is closed, the lips lie flush with the bottom of the cathode. In other words, the lips can only ensure an efficient dredging of the base of the pot at the sole level of their closing zone, so much so that in the long run it is necessary to drain the pots in order to ensure effective cleaning of the latter, therefore implying a stoppage of the installation, failing which a significant fall occurs in the yield from the said installations.

Moreover, the shovel being intended to work in a hostile and aggressive environment (temperature of the electrolytic bath close to 800° C., very acidic fluorine-containing fumes, etc.), it is not feasible to resort to sensors for managing the vertical travel of the shovel as a function of the degree of closure of the buckets.

The object of the invention is to eliminate these drawbacks. It relates to a unit for the collection, cleaning and calibration of electrolysis pots and, more precisely, of the anodic orifices, as the anodes are replaced, by means of which unit a calibration of these orifices, the collection of waste inherent in the rupture of the crust which forms at the surface of the bath and, furthermore, the cleaning of the base of the pot by dredging can be simultaneously ensured.

This unit comprises two buckets hinge-mounted at the level of the lower end of a chassis movable in vertical displacement, the free edge of each of the said buckets being liable to be bestowed with a circular movement by means of a closing and opening connecting rod assembly.

According to the invention, the unit comprises a first chassis, joined to a vertical displacement mast, referred to as the shovel-bearing chassis, and a second chassis, referred to as the buckets-supporting chassis, mechanically linked to the said shovel-bearing chassis and liable to displacement relative to the latter, the said buckets-supporting chassis integrating the connecting rod assembly for closing and opening the buckets, the said buckets being hinge-mounted at the lower end of this chassis.

In other words, the invention consists in adding to the traditional support of the actual tools constituting the shovel a chassis linked to the said support but nevertheless movable relative to the latter, this mobility being intended to allow the execution of a movement simultaneous with the buckets-closing operation and appropriate for compensating the circular movement of the lips of the said buckets in such a way as to impart to the lips a substantially rectilinear movement, parallel to the plane of the base of the pot.

The shovel is thereby endowed with one of the functions for which it is required, namely the operation involving dredging of the base of the pot.

According to one characteristic of the invention, the closing connecting rod assembly of the buckets comprises a force-transmitting rod, one of whose ends is hinge-mounted directly or indirectly on the said buckets so as to impart to their free lower edge a circular movement as the shovel is closed and whose other end is hinge-mounted on a rotary connecting rod, itself hinge-mounted on the buckets-supporting chassis, the said rotary connecting rod being mechanically linked to the shovel-bearing chassis by means of a compensating rod and being set into rotation, moreover, by means of an actuating jack, the point of application of which is integral with the buckets-supporting chassis.

According to an advantageous characteristic of the invention, the actuating jack is made undersized by means of a calibrated spring, resting on the shovel-bearing chassis and liable to absorb, at the level of the body of the jack, a part of the forces and, in particular, the compensation of the mass constituted by the movable aggregate, that is to say the closing connecting rod assembly of the buckets and the buckets themselves. This spring can be replaced by an equivalent member, such as, for example, a guided counter-weight connected to a cable and a return pulley.

The manner in which the invention can be realized and the advantages which follow therefrom will be more clearly apparent from the following illustrative embodiment, provided on an indicative and non-limiting basis in support of the appended figures.

DESCRIPTION OF THE PREFERRED EMBODIMENT

Figure 1:
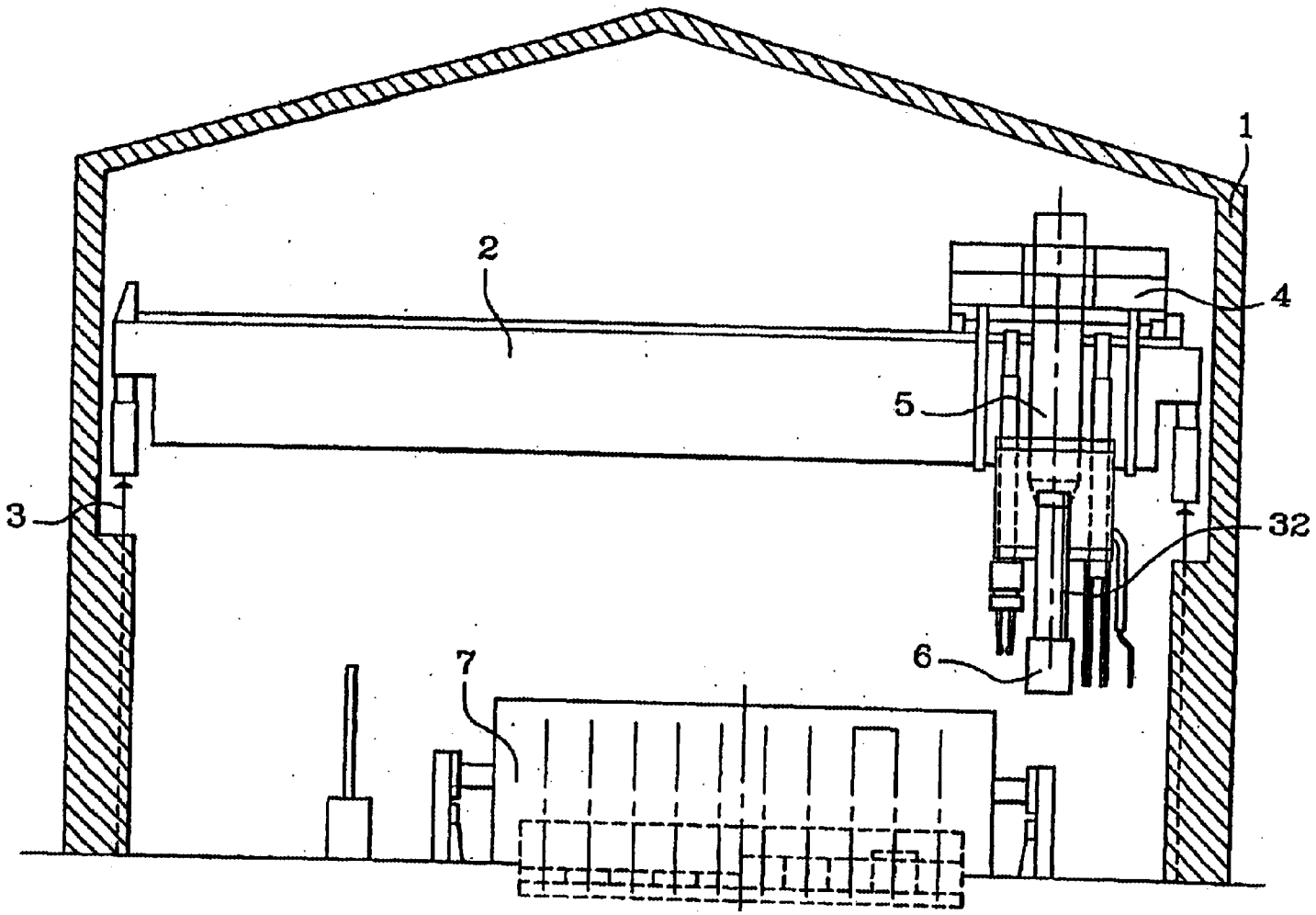
FIG. 1 is a diagrammatic representation in front view of an installation for the production of aluminium by igneous electrolysis, on which the collection and cleaning unit in accordance with the invention has been represented, in the non-operating position.

Within FIG. 1, a diagrammatic front view has been represented of the hall (1) of an aluminium production installation using the said igneous electrolysis technology.

The front of a series of electrolysis pots, substantially mutually identical and obviously mounted in series so as to allow the realization of the actual electrolysis process, has been represented by the reference (7). These pots are surmounted by a roller conveyor (3), on which a travelling bridge (2), designed in a known manner to allow the displacement of a certain number of tools appropriate for enabling the installation to operate, is liable to be displaced.

The said roller conveyor is designed, in particular, to allow the displacement, in a direction perpendicular to the direction of advancement of the bridge (2), of a trolley (4) resting upon the bridge (2), the said trolley bearing a tool intended to allow each of the pots to be cleaned and prepared during the replacement phases of the spent anodes at the level of the said pots.

In the traditional language used in the field under consideration, this tool is referred to as a "shovel".

In FIG. 1, the actual shovel, in the retracted, that is to say non-operating, position, has been represented by the general reference (6).

Figure 2:
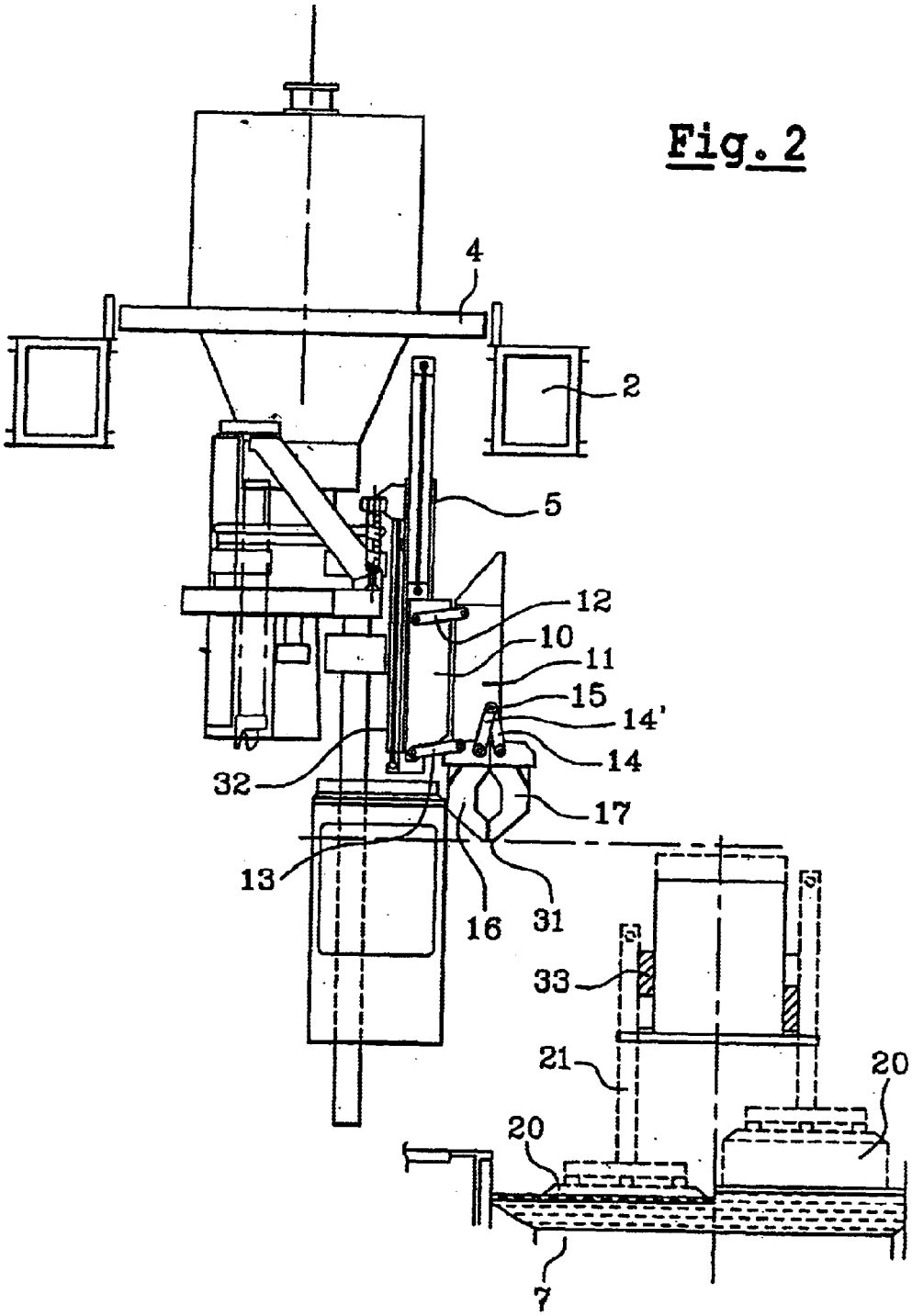
FIG. 2 is a more detailed lateral view of the said unit, still in the non-operating position.
Figure 3:
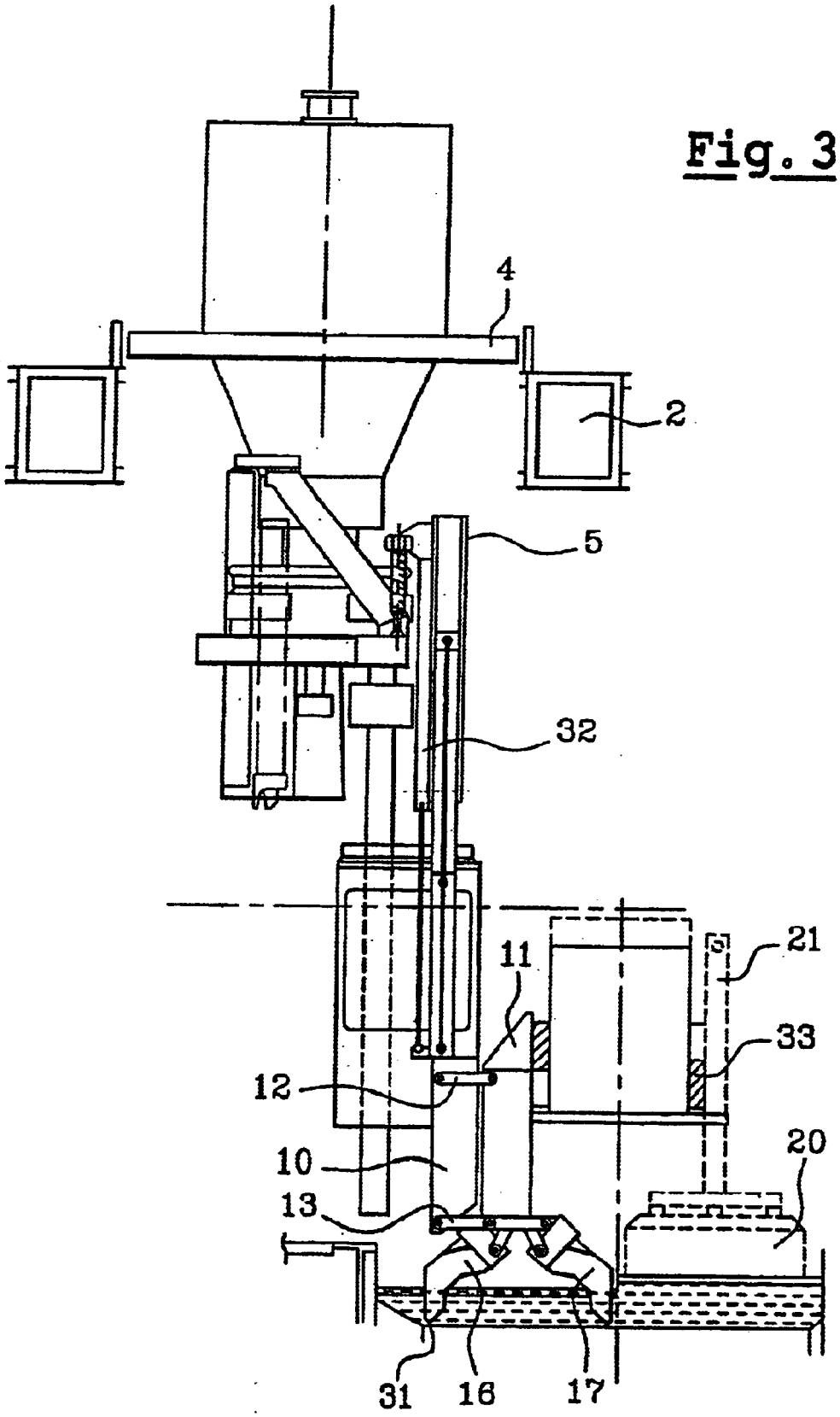
FIG. 3 is a view analogous to FIG. 2, but with the collection unit being in the operating position.

In connection with FIGS. 2 and 3, in which the tool is represented in a lateral position, the shovel (6) has been portrayed respectively in the retracted, thus non-operating, position and in the operating position.

As can be observed, this tool is mounted on a telescopic mast (5), if the travel of the shovel so requires, the said mast being actuated by means of an electromechanical, hydraulic or pneumatic lifting system (32). This telescopic mast (5) is integral with the trolley (4) and operates in association with coder members (not represented) appropriate for precisely determining the altitude of the shovel and, in particular, of the buckets (16, 17) which constitute it.

In fact, as already mentioned in the preamble of the present invention, it is advisable, by means of this tool, to fulfil a certain number of functions, yet to avoid harming the cathode constituted by the base of the electrolysis pots. It is therefore necessary to be in permanent command of the effective height of the said buckets, on the one hand when the shovel (6) approaches the level of the upper opening of the pots, defining a zone of introduction and, on the other hand, when the buckets are situated inside the said pots.

To the end of the telescopic mast (5) a first chassis (10) is joined, referred to as the shovel-bearing chassis. According to one characteristic of the invention, this chassis (10) is connected to a chassis (11), hereinafter referred to as the buckets-supporting chassis, by means of two links, (12) and (13) respectively, positioned in the described example at the lower and upper end of the said chassis.

These links are hinge-mounted respectively at the level of the chassis (10) and (11), according to parallel hinge axles between them.

They are intended to allow a relative movement of the buckets-supporting chassis (11) relative to the shovel-bearing chassis (10), as will be described in much greater detail below.

As can be observed in FIGS. 2 and 3, the end of the buckets-supporting chassis (11) receives the two buckets (16) and (17) constituting the actual shovel (6) and the maximum spacing of which, such as represented in FIG. 3, substantially corresponds to the spatial requirement generated by a new anode.

In FIGS. 2 and 3, such an anode has been represented by the reference (20). The stem (21) of the anode is fixed to the anodic frame (33), supplying the said anodes with electricity in a known manner, by means of connectors (not represented). The anodes (20) wear away in the course of the electrolytic process, thereby necessitating their regular replacement.

Figures 4, 5, 6:
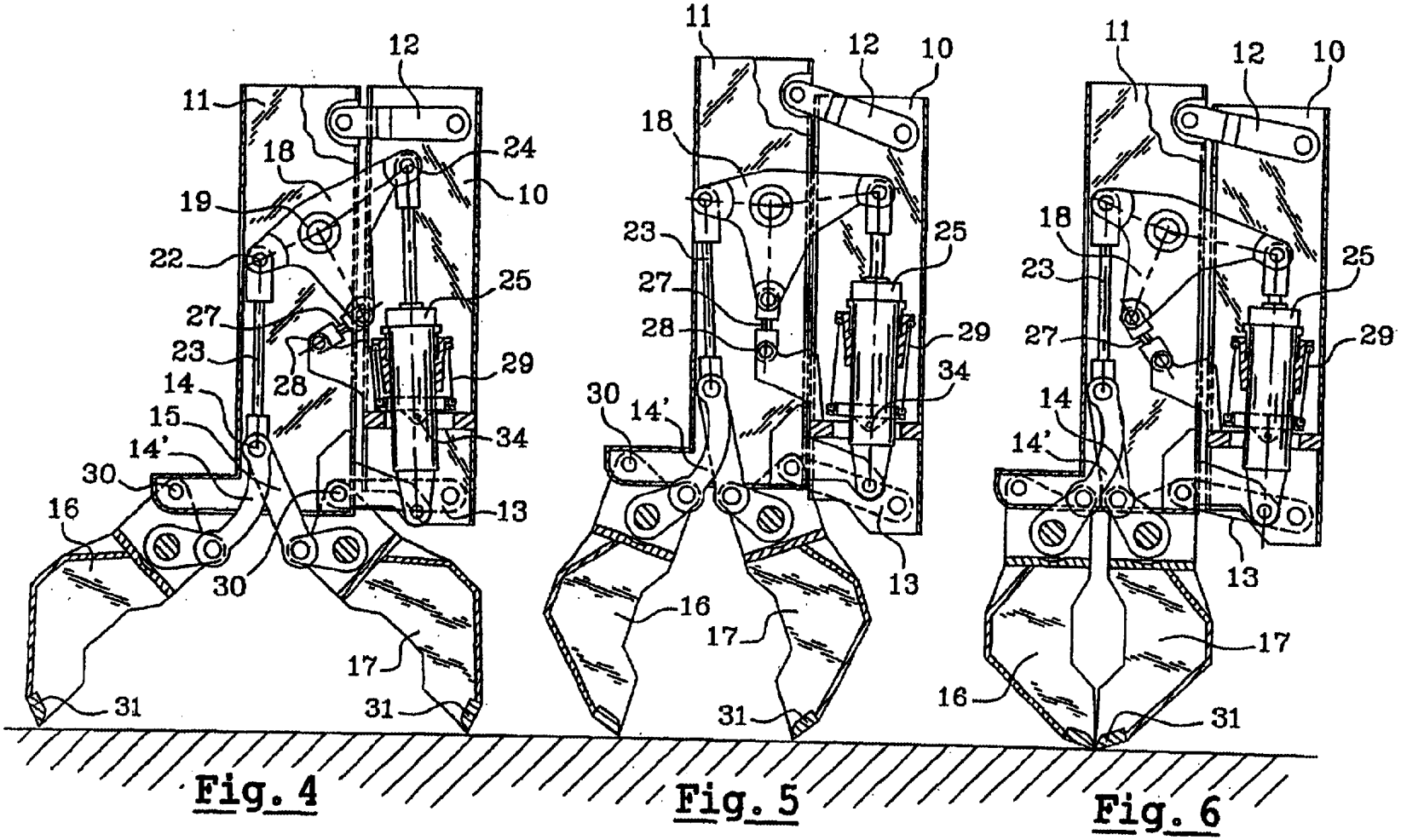
FIGS. 4, 5 and 6 are detailed diagrammatic representations of the said unit, the buckets being respectively in a fully open, intermediate and fully closed position.

The different members forming part of the constitution of the shovel (6), as well as their modus operandi, have been represented in connection with FIGS. 4, 5 and 6.

It is first worth pointing out that the buckets (16) and (17) are each hinge-mounted on the buckets-supporting chassis

(11) at the level of a hinge axle (30). In this way, the lip-constituting edge (31) of each of the buckets is liable, by virtue of this articulation, to describe a circular movement relative to the said axle(30).

In order to do this, the movement of each of the buckets (16) and (17) can be ensured by a closing connecting rod assembly (14), linked by way of a rod (23) hinge-mounted at the level of a hinge axle (15) to a rotary actuating connecting rod (18), as can clearly be observed in connection with FIGS. 4 to 6.

In other words, the closing connecting rod assembly is constituted, on the one hand, by the intermediate connecting rod (23) and, on the other hand, by two links (14, 14'), hinge-mounted respectively on the buckets (16) and (17) and at the lower end of the intermediate connecting rod (23). In the described example, the link (14') is in the shape of an arc in order to allow for the obstacles which it is liable to meet during its travel.

The other end of the intermediate connecting rod (23) is hinge-mounted by a hinge axle (22) on the rotary actuating connecting rod (18) having a particular profile.

In fact, this connecting rod is substantially triangular in shape and has, in particular, three arms, at the end of which are hinge-mounted three different members. As already mentioned, at the end of the first arm is hinge-mounted the end of the intermediate connecting rod (23) acting upon the closing connecting rod assembly (14).

The opposite arm receives the free end of the stem of an actuating jack (25), hinge-mounted on a hinge axle (24) disposed at the end of the said arm. The jack (25) is intended to ensure the rotation of the rotary actuating connecting rod (18) relative to its actuating axle (19). This axle (19) is integral with the buckets-supporting chassis (11). The point of application of this jack is integral with the buckets-supporting chassis (11).

Furthermore, in order to limit the dimensioning of the members constituting the jack (25) and considering the forces to be realized, on the one hand, and the weight of the two buckets (16) and (17) and the closing connecting rod assembly (14, 14', 23) on the other hand, a calibrated spring (29), resting on the shovel-bearing chassis (10), is joined to the body of the said jack (25). More precisely, the spring (29) is mounted on a swivel joint (34), integral with the shovel-bearing chassis (10). It is thereby possible for the spring to rock so as to follow the travel of the jack body, this also pivoting given that it is joined to the end of one of the arms of the rotary connecting rod (18). This rocking movement can clearly be observed, quite specifically, in FIGS. 4 to 6, as a function of the degree of rotation of the said connecting rod (18). Hence, the action of the spring (29) is always optimal.

The jack (25) is actuated by means of a pneumatic source of compressed air (not represented) extending inside the telescopic mast (5).

Finally, at the free end of the third arm of the rotary actuating connecting rod (18), extending substantially perpendicular to the first two arms, a so-called compensating rod (27) comes to pivot on an axle (26), the other end of which rod comes to pivot on an axle (28) disposed on the shovel-bearing chassis (10).

The modus operandi of this shovel will be described in greater detail, in accordance with the invention.

In FIG. 4, the buckets (16, 17) are in the fully open position. According to this configuration, the plane containing the lip (31) of the said bucket (17) extends substantially perpendicularly relative to the bottom of the cathode, that is to say of the pot.

The travel of the actuating jack (25) is therefore maximal and, consequently, the closing connecting rod assembly (14, 14', 23) has reached its lower minimum travel level.

At the same time, the two connecting rods (12) and (13), joining the buckets-supporting chassis (11) to the shovel-bearing chassis (10), are substantially horizontal.

When the actuator jack (25) is actuated, a rotation of the rotary actuating connecting rod (18) in the clockwise direction is generated in FIG. 5, firstly giving rise to an initial upward rise of the intermediate connecting rod (23) and hence of the closing connecting rod assembly (14, 14'), manifested by a commencement of closing of the buckets. Consequently, this action sets off the rotation in the trigonometric direction of the compensating rod (27), to the point where its maximum height, represented in FIG. 5, is reached.

Given the hinge-mounting of the said compensating rod (27) on the shovel-bearing chassis (10), this rotation generates an upward displacement of the buckets-supporting chassis (11), as is portrayed in FIG. 5 by the inclination of the connecting rods (12) and (13) for joining the said buckets-supporting chassis (11) to the shovel-bearing chassis (10).

This upward displacement of the buckets-supporting chassis (11) generates, consequently, the rise of the lip (31) of the buckets (16) and (17). Such that, notwithstanding the circular travel of the said lips, a displacement thereof along a horizontal plane, substantially parallel to the base of the pot, can be realized by playing on the compensation exerted by the relative displacement of the buckets-supporting chassis (11) relative to the shovel-bearing chassis (10).

Once the travel of the jack (25) is completed (FIG. 6), the two buckets (16) and (17) come into contact one with the other, particularly at the level of their respective lips (31), thus ensuring the closure of the shovel and, at the same time, the end of the rotation of the compensating rod (27) in the trigonometric direction, this end being inherent in the possible end of the travel of the stem in the jack (25). By corollary, given the travel assigned to the said compensating rod (27), a slight fall of the said buckets, and hence of the lips (31), is ensured. Given the particular profile of the buckets, the upwardly directed circular arc of concavity described by the said lips (31) is thus compensated by an inverse movement of the buckets-supporting chassis (11), such as ultimately to impart a relatively flat advancement of the said lips (31) as the shovel (6) is closed, and this by means of the compensating rod (27). Clearly, the dimensions of these different connecting rods are a function of the particular profile of the buckets and of the respective dimensions of the pots. That said, these dimensions, the principle having been established, are perfectly determinable by the person skilled in the art.

In this way, the shovel ensures the function which is assigned to it, namely, in particular, the collection of the various debris and other fragments originating from the anodes or from the upper crust of the bath, without harming the cathode, that is to say the base of the pot, whilst at the same time allowing a gentle dredging of the latter.

This result is obtained by means of a device which is simple to use and is relatively rustic, allowing the mechanical and technical stresses to be withstood within a hostile environment in which such devices are intended to operate.

What is claimed is:

1. Unit for collection, cleaning and calibration of anodic orifices of electrolysis pots, as the anodes of an installation for the production of aluminum by igneous electrolysis are replaced, comprising:

a shovel-bearing chasis having two buckets hinge-mounted at a level of a lower end of said shovel-bearing chassis, said shovel-bearing chassis being movable in a vertical direction, a lower edge of each of said buckets being moveable in a circular motion by a connecting rod assembly;

said shovel-bearing chassis joined to a vertical guide mast; and a buckets-supporting chassis mechanically linked to said shovel-bearing chassis and movable relative to said shovel-bearing chassis said buckets-supporting chassis integrating the connecting rod assembly for closing and opening the buckets, said buckets being hinge-mounted at the lower end of said buckets-supporting chassis; and said shovel-bearing chassis and said buckets-supporting chassis being simultaneously movable to allow said lower edge of each of said buckets to move in a same horizontal plane relative to each other during the circular motion of said buckets.

2. Unit for the collection, cleaning and calibration of electrolysis pots according to claim 1, wherein the closing connecting rod assembly comprises force-transmitting rod having an end operatively hinge-mounted on said buckets to impart to said lower edge the circular movement during a closing operation of the shovel, said assembly having another end hinge-mounted on a rotary actuating connecting rod which is hinge-mounted on the buckets-supporting chassis, said rotary connecting rod being mechanically linked to the shovel-bearing chassis of a compensating rod, which is hinge-mounted on the shovel-bearing chassis, said rotary connecting rod being set into rotation, by an actuator jack, which has a point of application integral with the buckets-supporting chassis.

3. Unit for the collection, cleaning and calibration of electrolysis pots according to claim 2, wherein the rotary actuating connecting rod comprises a hinge axle having three arms extending therefrom said arms mounted on the buckets-supporting chassis, two of the arms being substantially co-linear and receiving respectively an axle or actuating stem of the actuator jack and one of the ends of the force transmitting rod of the closing connecting rod assembly, a third arm of said arms extending substantially perpendicularly relative to the other two arms and receiving, at the level of its free end, a hinge axle of the compensating rod.

4. Unit for the collection, cleaning and calibration of electrolysis pots according to claim 2, wherein said unit additionally comprises a calibrated spring, for absorbing, at the level of the body of the actuator jack, a part of a force the force comprising a compensation of a mass constituted by the closing connecting rod assembly and the buckets, said spring being integral with the shovel-bearing chassis.

5. Unit for the collection, cleaning and calibration of electrolysis pots according to claim 4, wherein the calibrated spring is mounted on a swivel joint, joined to the shovel-bearing chassis to allow said spring to execute a rocking movement parallel with that of the jack as the rotary connecting rod is rotated.

6. Unit or the collection, cleaning and calibration of electrolysis pots according to claim 1, wherein the mast is telescopic and is actuated by an electromechanical, hydraulic or pneumatic lifting system.

7. Unit for the collection and cleaning of electrolysis pots according to claim 1 wherein said unit is mounted on a trolley displaceable on a traveling bridge running above the pots.

8. Unit for the collection, cleaning and calibration of electrolysis pots according to claim 3, wherein said unit additionally comprises a calibrated spring, for absorbing, at the level of a body of the actuator jack, a part of a force comprising a compensation of a mass constituted by the closing connecting rod assembly and the buckets, said spring being integral with the shovel-bearing chassis.

9. Unit for the collection, cleaning and calibration of electrolysis pots according to claim 2, wherein the mast is telescopic and is actuated by an electromechanical, hydraulic or pneumatic lifting system.

10. Unit for the collection, cleaning and calibration of electrolysis pots according to claim 3, wherein the mast is telescopic and is actuated by an electromechanical, hydraulic or pneumatic lifting system.

11. Unit for the collection, cleaning and calibration of electrolysis pots according to claim 4, wherein the mast is telescopic and is actuated by an electromechanical, hydraulic or pneumatic lifting system.

12. Unit for the collection, cleaning and calibration of electrolysis pots according to claim 8, wherein the mast is telescopic and is actuated by an electromechanical, hydraulic or pneumatic lifting system.

13. Unit for the collection, cleaning and calibration of electrolysis pots according to claim 5, wherein the mast is telescopic and is actuated by an electromechanical, hydraulic or pneumatic lifting system.

14. Unit for the collection and cleaning of electrolysis pots according to claim 2, wherein said unit is mounted on a trolley displaceable on a traveling bridge running above the pots.

15. Unit for the collection and cleaning of electrolysis pots according to claim 3, wherein said unit is mounted on a trolley displaceable on a traveling bridge running above the pots.

16. Unit for the collection and cleaning of electrolysis pots according to claim 4, wherein said unit is mounted on a trolley displaceable on a traveling bridge running above the pots.

17. Unit for the collection and cleaning of electrolysis pots according to claim 8, wherein said unit is mounted on a trolley displaceable on a traveling bridge running above the pots.

18. Unit for the collection and cleaning of electrolysis pots according to claim 5, wherein said unit is mounted on a trolley displaceable on a traveling bridge running above the pots.

19. Unit for the collection and cleaning of electrolysis pots according to claim 6, wherein said unit is mounted on a trolley displaceable on a traveling bridge running above the pots.

20. Unit for the collection and cleaning of electrolysis pots according to claim 9, wherein said unit is mounted on a trolley displaceable on a traveling bridge running above the pots.

* * * * *

UNITED STATES PATENT AND TRADEMARK OFFICE

CERTIFICATE OF CORRECTION

PATENT NO. : 6,643,957 B2
DATED : November 11, 2003
INVENTOR(S) : Piron et al.

It is certified that error appears in the above-identified patent and that said Letters Patent is hereby corrected as shown below:

Column 7,
Line 25, insert -- a -- after the word "comprises"
Line 52, insert a -- , -- after the word "force"

Signed and Sealed this

Seventeenth Day of February, 2004

JON W. DUDAS
*Acting Director of the United States Patent and Trademark Office*